US011946464B1

(12) United States Patent
Demski

(10) Patent No.: US 11,946,464 B1
(45) Date of Patent: Apr. 2, 2024

(54) SELF-CONTAINED ACTUATING MAGNETIC PUMP

(71) Applicant: P3 Technologies, LLC, Jupiter, FL (US)

(72) Inventor: Brandon A. Demski, Jupiter, FL (US)

(73) Assignee: P3 Technologies, LLC, Jupiter, FL (US)

( * ) Notice: Subject to any disclaimer, the term of this patent is extended or adjusted under 35 U.S.C. 154(b) by 0 days.

(21) Appl. No.: 17/862,259

(22) Filed: Jul. 11, 2022

(51) Int. Cl.

| | |
|---|---|
| ***F04B 39/06*** | (2006.01) |
| ***F04B 35/04*** | (2006.01) |
| ***F04B 37/18*** | (2006.01) |
| ***F04B 39/12*** | (2006.01) |
| ***F04B 49/06*** | (2006.01) |
| ***F04B 53/06*** | (2006.01) |

(52) U.S. Cl.
CPC ..... *F04B 39/06* (2013.01); *F04B 35/045* (2013.01); *F04B 37/18* (2013.01); *F04B 39/121* (2013.01); *F04B 49/06* (2013.01); *F04B 53/06* (2013.01)

(58) Field of Classification Search
CPC ..... F04B 17/04; F04B 39/06; F04B 39/12; F04B 35/045; F04B 37/18; F04B 39/121; F04B 49/06; F04B 49/065; F04B 53/06
See application file for complete search history.

(56) References Cited

U.S. PATENT DOCUMENTS

| | | | | |
|---|---|---|---|---|
| 4,122,378 | A * | 10/1978 | Brown | H02K 33/10 318/128 |
| 2014/0314604 | A1* | 10/2014 | Nagura | F04B 39/121 417/559 |
| 2016/0053750 | A1* | 2/2016 | Teylor | F04B 17/042 417/50 |
| 2017/0082094 | A1* | 3/2017 | Inatani | F02M 59/102 |
| 2020/0240540 | A1* | 7/2020 | Landacre | F04B 17/044 |
| 2022/0154709 | A1* | 5/2022 | Otsuka | F04B 53/10 |

* cited by examiner

*Primary Examiner* — Kenneth J Hansen
*Assistant Examiner* — David N Brandt
(74) *Attorney, Agent, or Firm* — Koenig IP Works, PLLC; Katherine Koenig

(57) ABSTRACT

A self-contained actuating magnetic pump (SCAMP) having an inlet valve and discharge valve, a piston, a compression cavity, an electromagnetic coil, a frame, and an armature to drive the piston. In one embodiment, the electromatic coils are isolated from the working fluid. In one embodiment, the SCAMP includes a housing that allows for thermal transfer from the electromagnetic coil to the working fluid. In one embodiment, the SCAMP includes a control unit that enables operation of the SCAMP in a power mode, a coast mode, and a retraction mode.

12 Claims, 6 Drawing Sheets

SELF-CONTAINED ACTUATING MAGNETIC PUMP

CROSS-REFERENCE TO RELATED APPLICATIONS

N/A.

GOVERNMENT RIGHTS STATEMENT

N/A.

FIELD

The present technology is related generally to pumps and/or compressors.

BACKGROUND

A typical cyclical positive displacement pump contains a cavity within the pump that changes volume during operation to compress the fluid within the confined space. When the compression stroke exceeds a specific pressure, a discharge valve opens, releasing the high-pressure fluid. Upon expansion of the cavity, this discharge valve closes, and an inlet valve opens due to the reduced pressure because of the expanding volume. Typical sources of motion for these pumps are combustion, electromagnetic, and piezoelectric. Compression cavities can be separated into to two major variants: diaphragm and piston.

Diaphragm pumps utilize a large surface area, thin web thickness material that oscillated from the center, with a fixed outer profile, to vary the compression volume. The varying of the diaphragm compression cavity is typically driven by piezoelectrics, which use an electrical current that runs through a material to cause an expansion and contraction effect, or via electromagnetics, which use a small solenoid and plunger to articulate the diaphragm. Due to the thin material, and wide surface area, these pumps are limited to very low pressures and relatively low flow rates.

In piston designs the compression volume is determined by the diameter of the piston across the reciprocating length. Unlike the diaphragm pump, a piston-driven one is not structurally limited by the materials, so the design is open to any size and shape. Typically, a cam is used to push a follower and piston rod forwards and aft using rotary motion. These types of pumps are usually driven by rotational electromagnetic motors or combustion engines. These electric-driven cam designs are usually high efficiency, but can be limited by the amount of power in the design due to thermal management of the motor, or the weight and size of the system can become unwieldly. Combustion designs can provide higher energy densities than the electric motors, but overall efficiency will be lower than that of the electric motor. In both these designs, because of the transition from rotational motion to reciprocal (linear) motion, seals are necessary to prevent backflowing the pumping fluid into the motors.

The self-contained actuating magnetic pump (SCAMP) is a variant of the piston design that utilizes a linear electric motor, or solenoid, to develop the electromotive force on the piston. By generating an electromagnetic field around the piston, the rotational motion element is eliminated from the design. This type of solenoid motion has been used for operating valves and actuators, but utilization as a pump has been limited. The major drawbacks of this type of motion for a pump is the efficiency is significantly reduced compared to a cam driven design as the singular arrangement.

SUMMARY

Some embodiments advantageously provide devices, systems, and methods of interacting with a working fluid to pump and/or compress the working fluid, and to fluidly isolate components such as electromagnetic coils from the working fluid.

In one embodiment, a device configured to interact with a working fluid includes: a linear motion electromagnet, the linear motion electromagnet including at least one electromagnetic coil, a frame, and an armature within an armature cavity; a compression cavity; a piston within a piston cavity, the piston cavity at least partially defining the compression cavity, the armature being attached to at least a portion of the piston; an inlet valve and a discharge valve, each of the inlet valve and the discharge valve being in fluid communication with the compression cavity; at least one spring within the armature cavity; and a secondary flow circuit, the secondary flow circuit being configured to isolate the at least one electromagnetic coil from the working fluid.

In one aspect of the embodiment, the working fluid is a cryogenic fluid.

In one aspect of the embodiment, the secondary flow circuit includes a shaft seal; and a fluid return passage.

In one aspect of the embodiment, the piston includes a shaft, the shaft seal being around the shaft of the piston.

In one aspect of the embodiment, the shaft seal fluidly isolates the compression cavity from the armature cavity.

In one aspect of the embodiment, the shaft seal is one of a mechanical seal, a hydrodynamic seal, and a combination thereof.

In one aspect of the embodiment, the fluid return passage extends from the armature cavity to a location upstream of the inlet valve.

In one aspect of the embodiment, the secondary flow circuit further includes a leak passage.

In one aspect of the embodiment, the device further includes a housing, the housing at least partially defining the compression cavity and the armature cavity and including a housing seal, the leak passage being configured to vent an amount of working fluid leaked through the housing seal to a surrounding environment.

In one aspect of the embodiment, the housing is configured to thermally transfer heat from the at least one electromagnetic coil into the working fluid.

In one aspect of the embodiment, the secondary flow circuit further includes a coil liner, the coil liner being configured to isolate the at least one electromagnetic coil from the working fluid.

In one aspect of the embodiment, the device further includes a shaft support system, the shaft support system including at least one of bushings, linear bearings, and hydrostatic bearings.

In one aspect of the embodiment, the device further includes a control unit, the control unit being in electrical communication with the at least one electromagnetic coil.

In one aspect of the embodiment, the control unit includes a control circuit, the control circuit having: a first major current flow path being configured to charge the at least one electromagnetic coil; a second major current flow path being a low-resistance circuit configured to retain a residual charge within the at least one electromagnetic coil; and a third major current flow path, the third major current flow path being a high-resistance circuit configured to dissipate the residual charge from the at least one electromagnetic coil.

In one aspect of the embodiment, the control unit further includes: a voltage supply with a voltage supply switch; a ground with a ground switch; a coasting switch; and a retraction switch, the ground switch and the voltage supply switch being closed with the coasting switch and retraction switch being open when a current is flowing through the first major current flow path; the ground switch, the voltage supply switch, and the retraction switch being open and the coasting switch being closed when the current is flowing through the second major current flow path; and the retraction switch being closed and the ground switch, the voltage supply switch, and the coasting switch being open when the piston is retracting when the current is flowing through the third major current flow path.

In one embodiment, a device configured to interact with a working fluid includes: a primary flow circuit for a working fluid, the primary flow circuit including a compression cavity, an inlet, and a discharge; a piston cavity and a piston within the piston cavity; an electromagnetic coil; an armature cavity and an armature within the armature cavity; and a secondary flow circuit, the secondary flow circuit being configured to fluidly isolate the electromagnetic coil from the working fluid.

In one aspect of the embodiment, the piston cavity at least partially defines the compression cavity, the secondary flow circuit including: a shaft seal around at least a portion of the piston, the shaft seal fluidly isolating the compression cavity from the armature cavity; a fluid return passage extending between the armature cavity and the inlet; a leak passage in vented communication to a surrounding environment; and a coil liner, the coil liner being configured to isolate the electromagnetic coil from the working fluid.

In one embodiment, a device includes: a housing, the housing including a first pump head at a first end of the housing, a second pump head at a second end of the housing opposite the first end of the housing, a piston cavity extending between the first pump head and the second pump head, and an armature cavity extending between the first pump head and the second pump head; a first inlet valve within the first pump head and a second inlet valve within the second pump head; a first discharge valve within the second pump head and a second discharge valve within the second pump head; a first electromagnetic coil within the first pump head and a second electromagnetic coil within the second pump head; a piston within the piston cavity; an armature within the armature cavity, the armature being attached to at least a portion of the piston; and a primary flow circuit for a working fluid, the primary flow circuit extending between the first discharge valve and the second inlet valve.

In one aspect of the embodiment, the device further includes a first armature spring within the armature cavity at a first end of the armature within the first pump head and a second armature spring within the armature cavity at a second end of the armature within the second pump head.

In one aspect of the embodiment, the housing is configured to thermally transfer heat from the first electromagnetic coil and the second electromagnetic coil into the working fluid.

BRIEF DESCRIPTION OF THE DRAWINGS

A more complete understanding of embodiments described herein, and the attendant advantages and features thereof, will be more readily understood by reference to the following detailed description when considered in conjunction with the accompanying drawings wherein.

DETAILED DESCRIPTION

Figure 1:
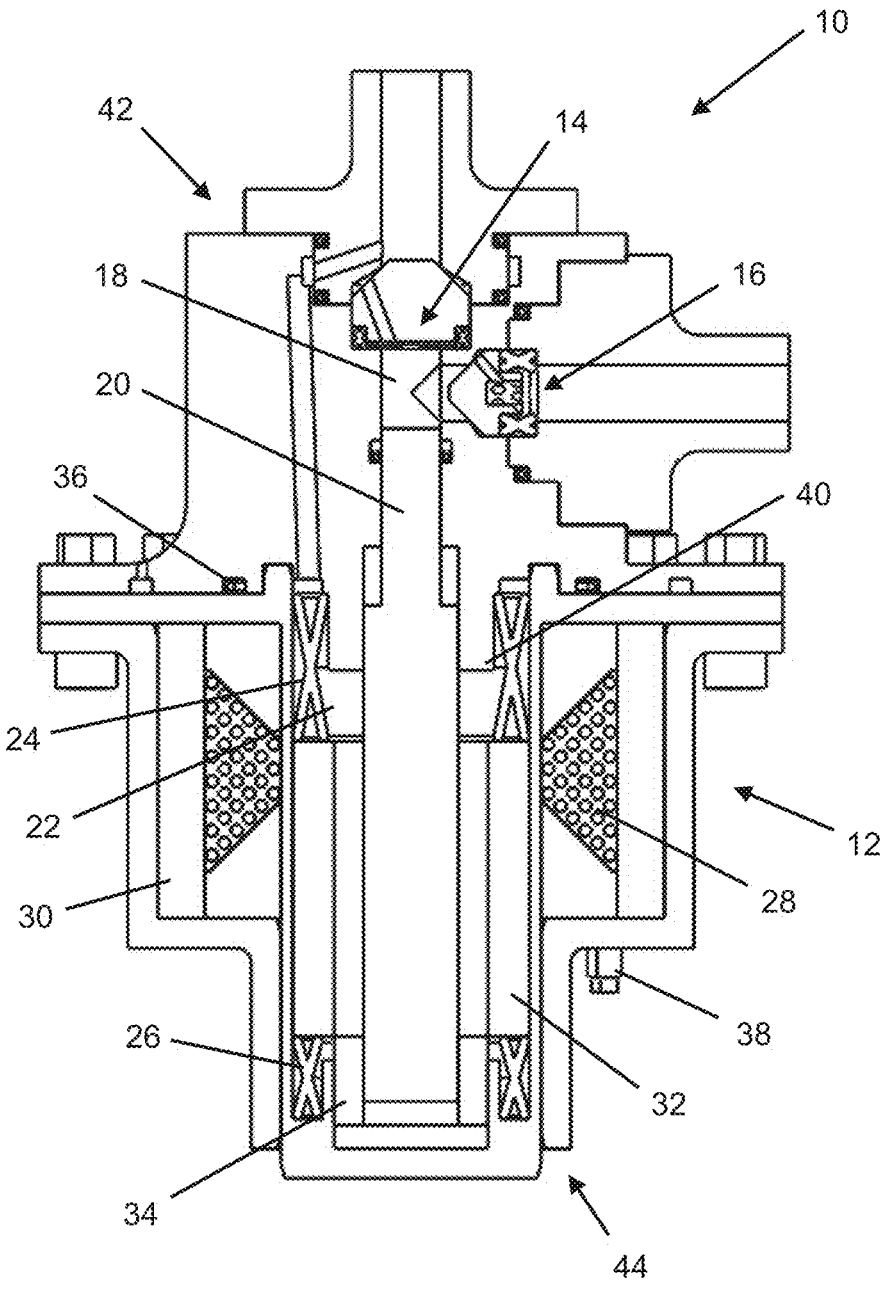
FIG. 1 shows a cross-section view of a first exemplary embodiment of the self-contained actuating magnetic pump (SCAMP), in accordance with the present disclosure.

Before describing in detail exemplary embodiments, it is noted that the embodiments reside primarily in combinations of apparatus components and methods of use related to self-contained actuating magnetic pumps (SCAMPs). Accordingly, the system and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The self-contained actuating magnetic pump (SCAMP) disclosed herein is a device configured to interact with a working fluid, and is configured for use with liquids and/or gases. The SCAMP of the present disclosure utilizes key design features when pumping cryogenic fluids that allow it to function in non-traditional ways. For example, in some embodiments the SCAMP operates as a fully segregated electromagnetic circuit and piston pump, enabling the compression of highly volatile fluids while mitigating the safety risks associated with pumping these fluids. In some embodiments, the SCAMP includes internal recirculation passages to distribute pressure within the pump solenoid cavity, as well as thermally regulate the electromagnetic coils. Coil and pump housings are designed to prevent ingestion of gases into the coils providing safety and reliability in volatile fluids. In some embodiments, mechanical design features of the SCAMP housing are integrated to transfer the thermal energy of the coils into the pumped fluid to enable high energy density coil designs. In some embodiments seal designs and kinematics are tailored around high velocity operation within a cryogenic environment to enable high flow rates, and/or material selections across the SCAMP are optimized to utilize the advantages of a cryogenic environment while providing safe operation in liquid oxygen. These features allow for the SCAMP to operate with high reliability and safety at flow rates or pressures not achievable with conventional pumps in cryogenic applications.

Figure 2:
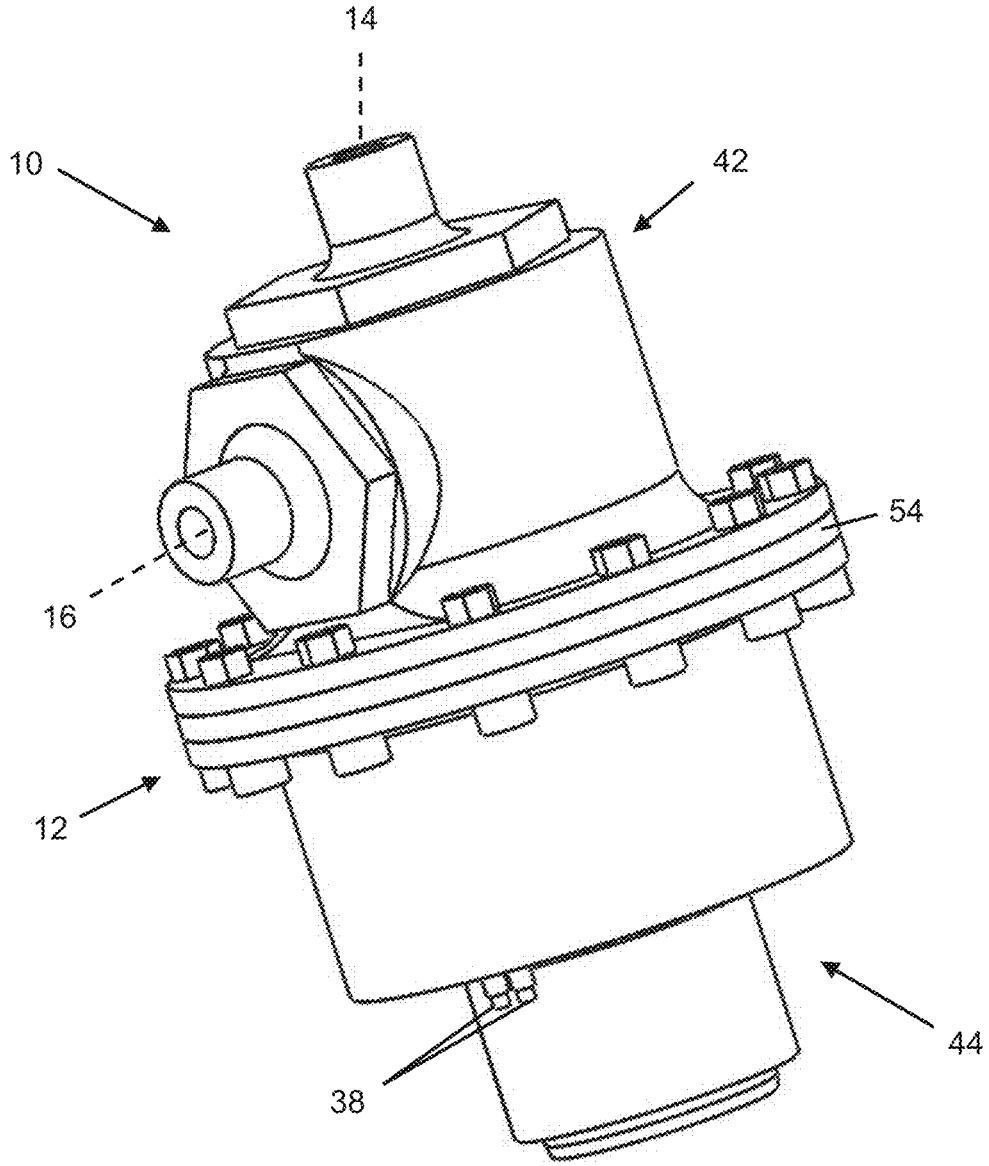
FIG. 2 shows a perspective view of the SCAMP of FIG. 1, in accordance with the present disclosure.
Figure 3:
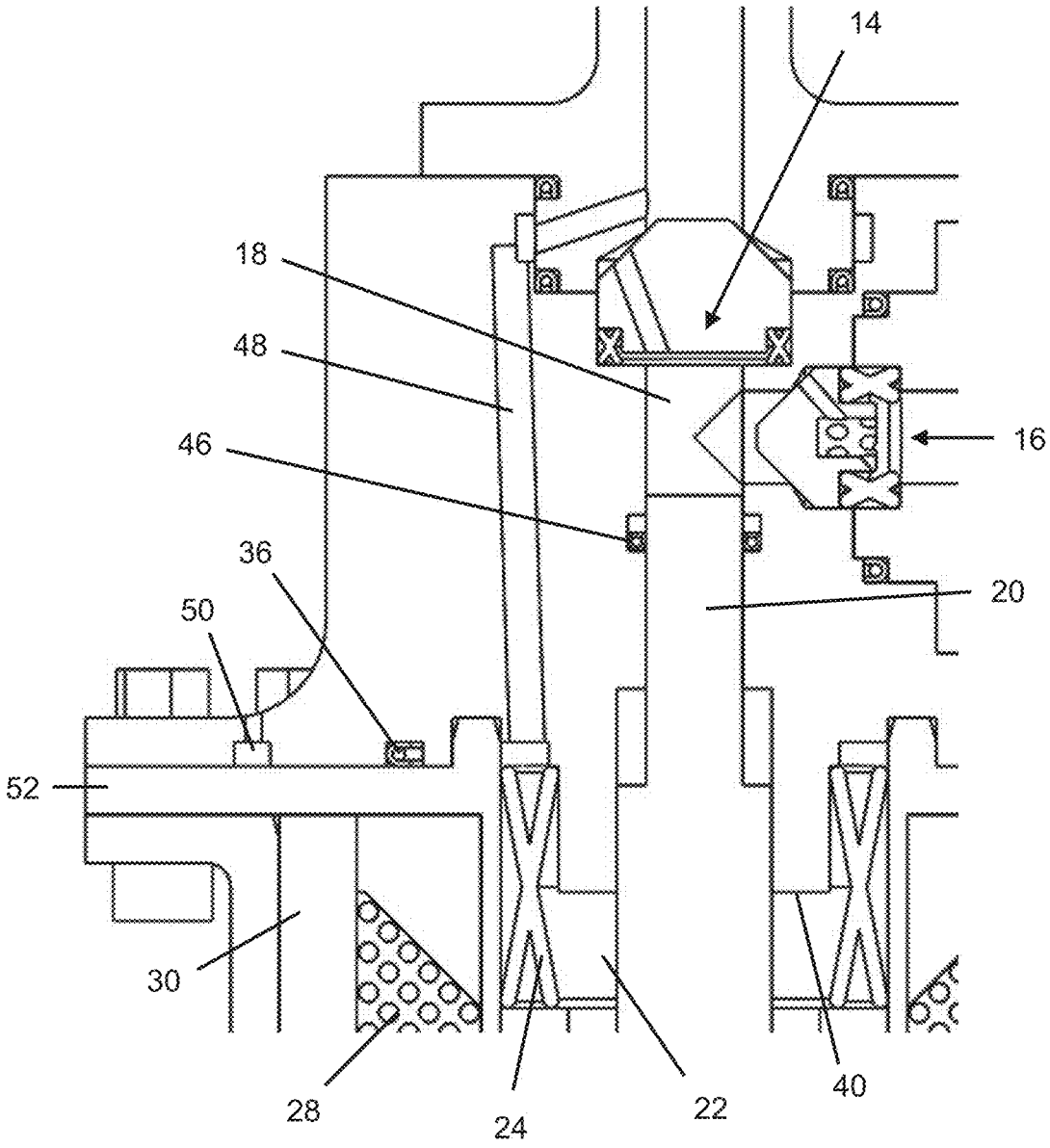
FIG. 3 shows a cross-section view of exemplary fluid return and egress passages of the SCAMP of FIG. 1, in accordance with the present disclosure.

Referring now to the figures in which like reference designators are used for like elements, a first exemplary embodiment of a SCAMP is shown in FIGS. 1-3. FIG. 1 shows a cross-section view of the SCAMP, FIG. 2 shows a perspective view of the SCAMP, and FIG. 3 shows a cross-section view of exemplary fluid return and egress passages of the SCAMP.

Referring now to FIGS. 1 and 2, in one embodiment the SCAMP is configured for use in liquids, such as cryogenic liquids. Thus, in one embodiment, the SCAMP is configured for use as a positive displacement pump. In one embodiment, the SCAMP 10 generally includes a pump housing 12, an inlet valve 14, a discharge valve 16, a compression cavity 18 in fluid communication with both the inlet valve 14 and the discharge valve 16, a piston 20, an armature cavity 22, and at least one spring (for example, overtravel and/or armature return spring(s)) at least partially within the armature cavity 22. In one embodiment, the at least one spring includes at least one first spring 24 (for example, an armature return spring) and at least one second spring 26 (for example, an overtravel spring). In one embodiment, the SCAMP 10 further includes a linear motion electromagnet that generally includes at least one electromagnetic coil 28, a frame at least partially surrounding the at least one electromagnetic coil 28, and a magnetically susceptible armature 32. In one embodiment, the SCAMP 10 also includes one or more bushings 34, a housing seal 36, one or more electrical takeouts 38, and/or other components. For example, in one embodiment the SCAMP 10 includes a shaft support system that includes bushings, linear bearings, and/or hydrostatic bearings.

Continuing to refer to FIGS. 1 and 2, the SCAMP 10 operates by changing the volume of the compression cavity 18 via actuation of the piston 20 within a piston cavity. In one embodiment, the compression cavity 18 is formed in the piston cavity, between the piston 20, the inlet valve 14, and the discharge valve 15, and the size of the compression cavity 18 is determined at least in part by the position of the piston 20 within the piston cavity. Flow of a fluid enters the compression cavity 18 through the inlet valve 14 during a stroke of the piston 20 in a first direction (for example, a retraction stroke of the piston 20 in a direction away from the inlet valve 14), and the flow of fluid is discharged during pressure rise through the discharge valve 16 during a stroke of the piston 20 in a second direction opposite the first direction (for example, an advancement stroke of the piston 20 in a direction toward the inlet valve 14). The intended fluid flow path through the SCAMP 10 (such as this inlet-to-discharge flow path and the discharge-to-inlet flow path shown in FIG. 7) is referred to as the primary flow circuit. Actuation of the piston 20 is achieved by the armature 32, which is attached to at least a portion of the piston 20. The magnetic field to move the armature 32 is generated by providing an electrical current to the electromagnetic coil(s) 28 to generate a magnetic field with the frame 30 around the electromagnetic coil(s) 28 to guide the magnetic field toward the armature 32. In some embodiments, the SCAMP 10 includes a single electromagnetic coil 28. In other embodiments, the SCAMP 10 includes more than one electromagnetic coil 28, including but not limited to a bifilar winding or a trifilar winding. In one embodiment, motion of the armature 32 is restricted radially by a pair of bushings 34 and axially by travel stops 40 within the housing 12. In one embodiment, the pump housing 12 includes a valve housing at a first end 42 of the SCAMP 10 (also referred to herein as the "pump head") and a coil housing at a second end 44 of the SCAMP 10 (also referred to herein as the "pump base") opposite the first end 42. Retraction of the armature 32 is provided by movement of the at least one first spring 24 within the armature cavity 22 towards the first end 42. Overtravel mitigation is provided by the at least one second spring 26 at the second end 44. Electricity is provided to the SCAMP 10 via of the one or more electrical takeouts 38 on the housing 12. In one embodiment, the SCAMP 10 includes a pair of electrical takeouts 38 on a portion of the housing 12 proximate the electromagnetic coil(s) 28.

Referring now to FIG. 3, a cross-section view of exemplary fluid return and egress passages, referred to herein as a "secondary flow circuit," of the SCAMP 10 is shown. To enable high performance operation, the SCAMP 10 employs many features not utilized on traditional positive displacement pumps. Cryogenic fluids have incredibly low viscosity and molecular weight and as a result will leak past many seal designs, which makes them incredibly difficult to be pumped in rotary cam driven pumps. To aid pump reliability in these conditions, in some embodiments the SCAMP 10 includes a secondary flow circuit, such as that shown in FIG. 3, that completely isolates the electromagnetic coil(s) 28. In one embodiment, the secondary flow circuit includes a shaft seal 46 that is used to prevent flow of a working fluid, such as a cryogenic fluid, from bypassing the piston 20 and leaking into the armature cavity 22 from the piston cavity. In the embodiment shown in FIG. 3, the shaft seal 46 is a mechanical seal, including but not limited to spring energized, pressure assisted and component seals. However, it will be understood that hydrodynamic flow suppression features may be used in lieu of such mechanical solutions, for example, should the material degradation of the shaft seal 46 inhibit operational life. Thus, in one embodiment the shaft seal 46 is a hydrodynamic seal including but not limited to a hydrodynamic slider bearing which acts as the pump head shaft support system while providing a hydrodynamic pressure dam effect to mitigate shaft leakage losses in lieu of the shaft seal 46.

Continuing to refer to FIG. 3, in one embodiment the secondary flow circuit of the SCAMP 10 further includes a fluid return passage 48. If the working fluid leaks from the compression cavity 18 and through the shaft seal 46 and into the armature cavity 22, the working fluid will then pass through the fluid return passage 48 and be injected into a location upstream of the inlet valve 14. Thus, the fluid return passage 48 of the secondary flow circuit is configured to redirect any leaked working fluid from the armature cavity 22 back into the primary flow circuit.

Continuing to refer to FIG. 3, in one embodiment the secondary flow circuit of the SCAMP 10 further includes a leak passage 50 and a coil liner 52. Cryogenic fluids induce a significant risk in the event of the fluids reaching an ignition source, so should the housing seal 36 fail, the working fluid will pass into the leak passage 50 and away from the coil liner 52. Thus, in some embodiments leaked working fluid is vented to the surrounding environment through the leak passage 50. Further, the coil liner 52 also isolates the electromagnetic coil(s) 28 and the frame 30 and prevents them from ever being in contact with the working fluid (for example, cryogenic fluid), thereby providing significant safety margin when pumping hazardous materials. The housing 12 and the secondary flow circuit are designed in such a way that the heat generated by the electromagnetic coil(s) 28 can be rejected (transferred) into the working fluid, enabling the electromagnetic coil(s) 28 to operate well beyond traditional wire amperage limits without risk of burning out. In one embodiment, the fluid return passage 48 and the cycling of the armature 32 together enable a hydrodynamic fluid transfer in the armature cavity 22 to the electromagnetic coil(s) 28 via convective heat transfer. Additionally, in one embodiment the pump housing 12 to the coil liner 52 maximizes the thermal transfer via conductive heat transfer. Thus, the SCAMP 10 is configured to operate in a smaller volumetric package, at higher pressures and flow rates than currently known pumps.

Figure 4:
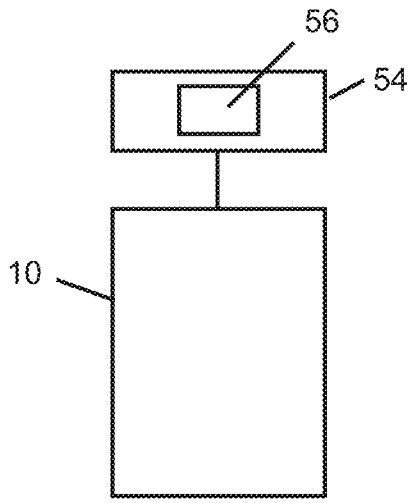
FIG. 4 shows a stylized configuration of a SCAMP and control circuit, in accordance with the present disclosure.
Figure 5:
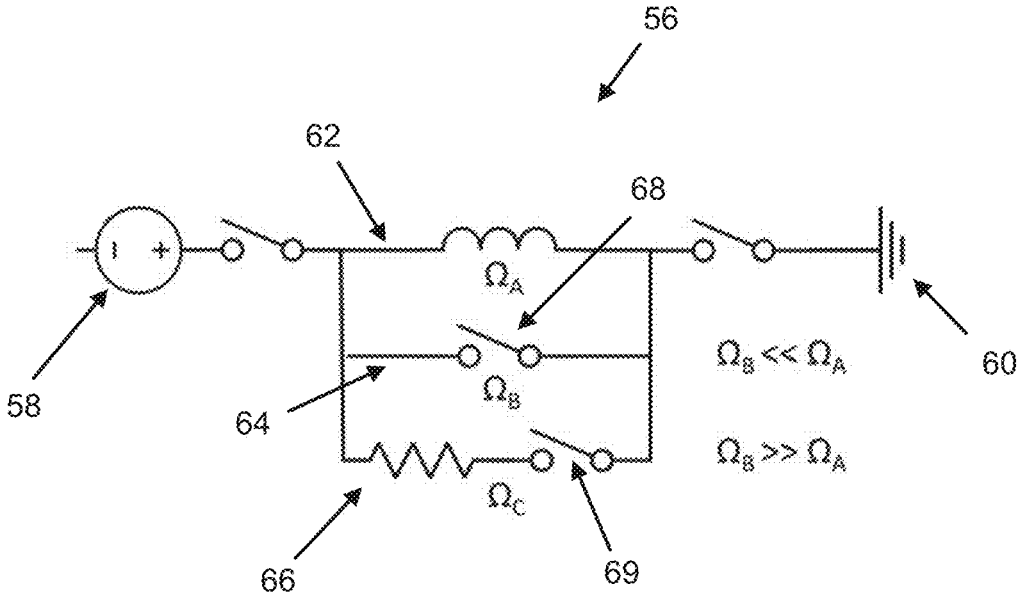
FIG. 5 shows a schematic diagram of the control circuit for a SCAMP, in accordance with the present disclosure.

Referring now to FIGS. 4 and 5, a control circuit 56 for the SCAMP 10 is shown. FIG. 4 shows a stylized configuration of a SCAMP 10 and controller and FIG. 5 shows a schematic diagram of the control circuit 56. The operation of the electromagnetic circuit provides the life, reliability, and efficiency of any solenoid pump, including the SCAMP 10 of the present disclosure. In one embodiment, the control unit 54, which includes a control circuit 56, is an external component that is in wired or wireless communication with one or more components of the SCAMP 10 (for example, as shown in FIG. 4). Additionally, it will be understood that the control unit 54 and control circuit 56 may be used with any of the SCAMP embodiments disclosed herein. In one embodiment, the major inputs and outputs of control circuit 56 of the SCAMP 10 are the voltage supply 58 and the ground 60, respectively.

Continuing to refer to FIGS. 4 and 5, in one embodiment, three major current flow paths exist within the control circuit 56. In one embodiment, all three major current flow paths operate through the electromagnetic coil(s) 28, but have different paths through the control unit 54. For example, in one embodiment each of the three major current flow paths is a connection between the voltage supply 58, through the electromagnetic coil(s) 28, to the ground 60. The first major current flow path 62, which may be referred to as a power mode, provides the "power-on" phase, charging the electromagnetic coil(s) 28 and providing the main energy for piston compression. The second major current flow path 64, which may be referred to as the coast mode, is a low-resistance circuit that allows the armature 32 to coast with minimal drag. In one embodiment, the second major current flow path 64 helps retain the residual charge within the electromagnetic coil(s) 28. Finally, the third major current flow path 66, which may be referred to as the retraction mode, is a high-resistance, or dump resistor, current flow path that allows for rapid retraction of the piston 20. In one embodiment, the third major current flow path 66 helps dissipate charge from the electromagnetic coil(s) 28.

Continuing to refer to FIGS. 4 and 5, during normal operation the first major current flow path 62 would be active with both the ground 60 and voltage supply 58 switches being closed. When the electromagnetic coil(s) 28 reach a predetermined charge state, either via predictive methodologies or active sensor input, the voltage supply 58 and ground 60 switches will open, and a coasting switch 68 within the second major current flow path 64 will close. This enables the electromagnetic coil(s) 28 to operate on its own internal resistance, maintaining magnetic charge to propel the piston 20 forward. In one embodiment, this phase will last until the piston runs out of momentum, which may be within 1% of the overall travel length from the axial travel stops. Once the piston 20 reaches the top of the stroke, the retraction phase begins. At this point, the electromagnetic coil(s) 28 still have significant charge built up, so the third major current flow path 66 (high-resistance current flow path) activates and a retracting switch 69 in the third major current flow path 66 will close. This will bleed the residual current and, in turn, the overcharge built up in the electromagnetic coil(s) 28, thereby enabling a much more rapid retraction cycle than if left to return uninfluenced. In the event that the kinetic energy built up in the electromagnetic coil(s) 28 is too high and the electromagnetic coil(s) 28 are retracting beyond the limits of the at least one second spring 26, the first major current flow path 62 can be charged to decelerate the retraction of the piston 20, preventing a bottoming out of the shaft of the piston 20. This premature power-on cycle can also be used to provide additional efficiency when operating at 100% duty cycle, as the third major current flow path 66 is engaged when operating at anything less than 100% flow capacity. However, as discussed below, in one embodiment the control circuit 56 of the SCAMP of FIG. 7 does not include the third major current flow path 66.

Figure 6:
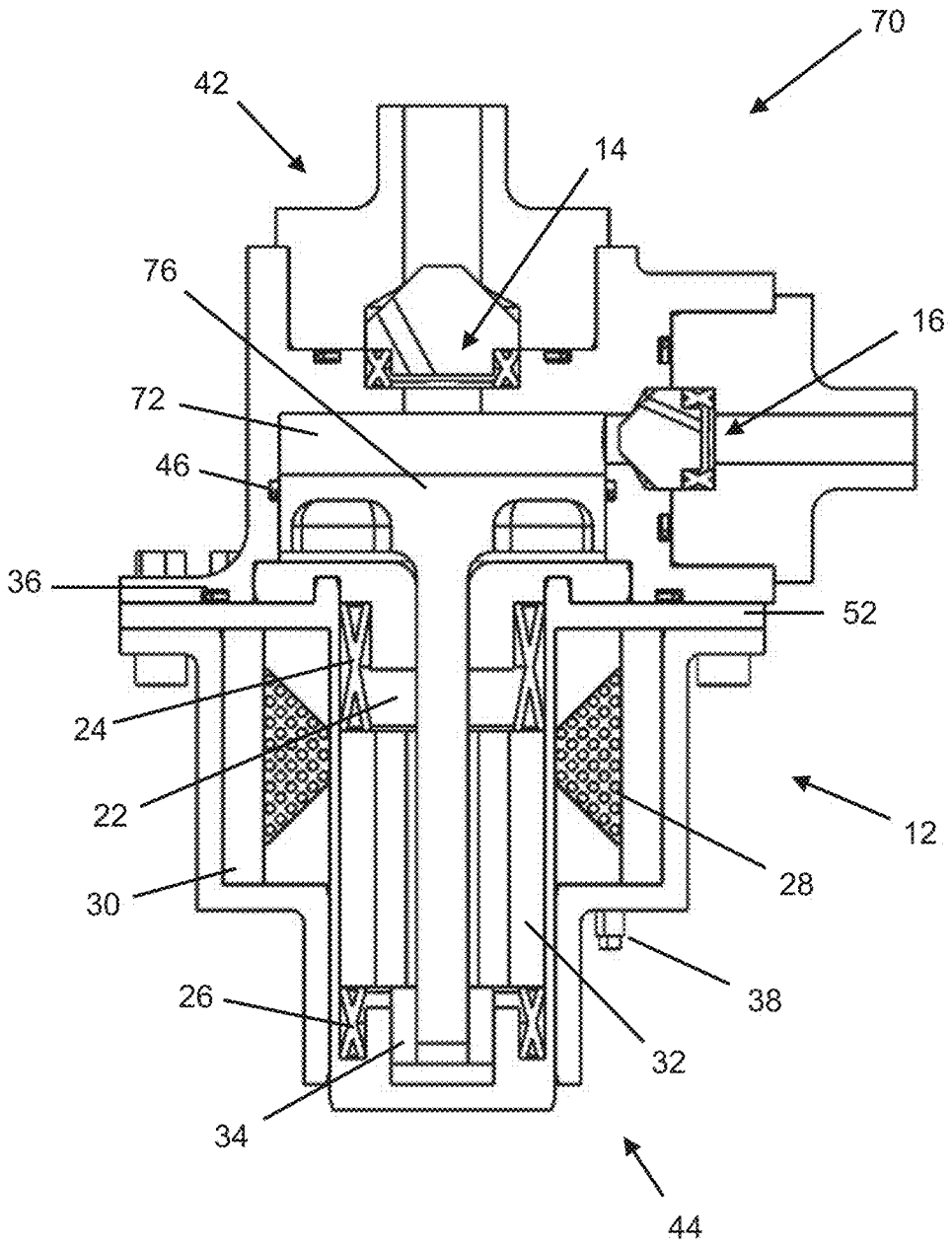
FIG. 6 shows a cross-section view of a second exemplary embodiment of a SCAMP for use as a compressor, in accordance with the present disclosure.

Referring now to FIG. 6, a cross-section view of a second exemplary embodiment of a SCAMP 70 for use as a compressor is shown. In one embodiment, the SCAMP 70 of FIG. 6 is configured for use with a gas as a working fluid, whereas the SCAMP 10 of FIGS. 1-3 is configured for use with a liquid as a working fluid. In one embodiment, the configuration and operation of the SCAMP 70 of FIG. 6 is substantially the same as that of the SCAMP 10 of FIGS. 1-3 (and like elements are depicted using like reference numbers), with the exception of compression cavity 72 and the piston 74. In the SCAMP 70 of FIG. 6, the compression cavity 72 is enlarged to manage the highly compressible properties of gases. In some embodiments, at least a portion of the piston 74 (for example, the piston head 76) is wider than that of the SCAMP 10 of FIGS. 1-3, which limits the amount of maximum pressure a single pump can provide.

Figure 7:
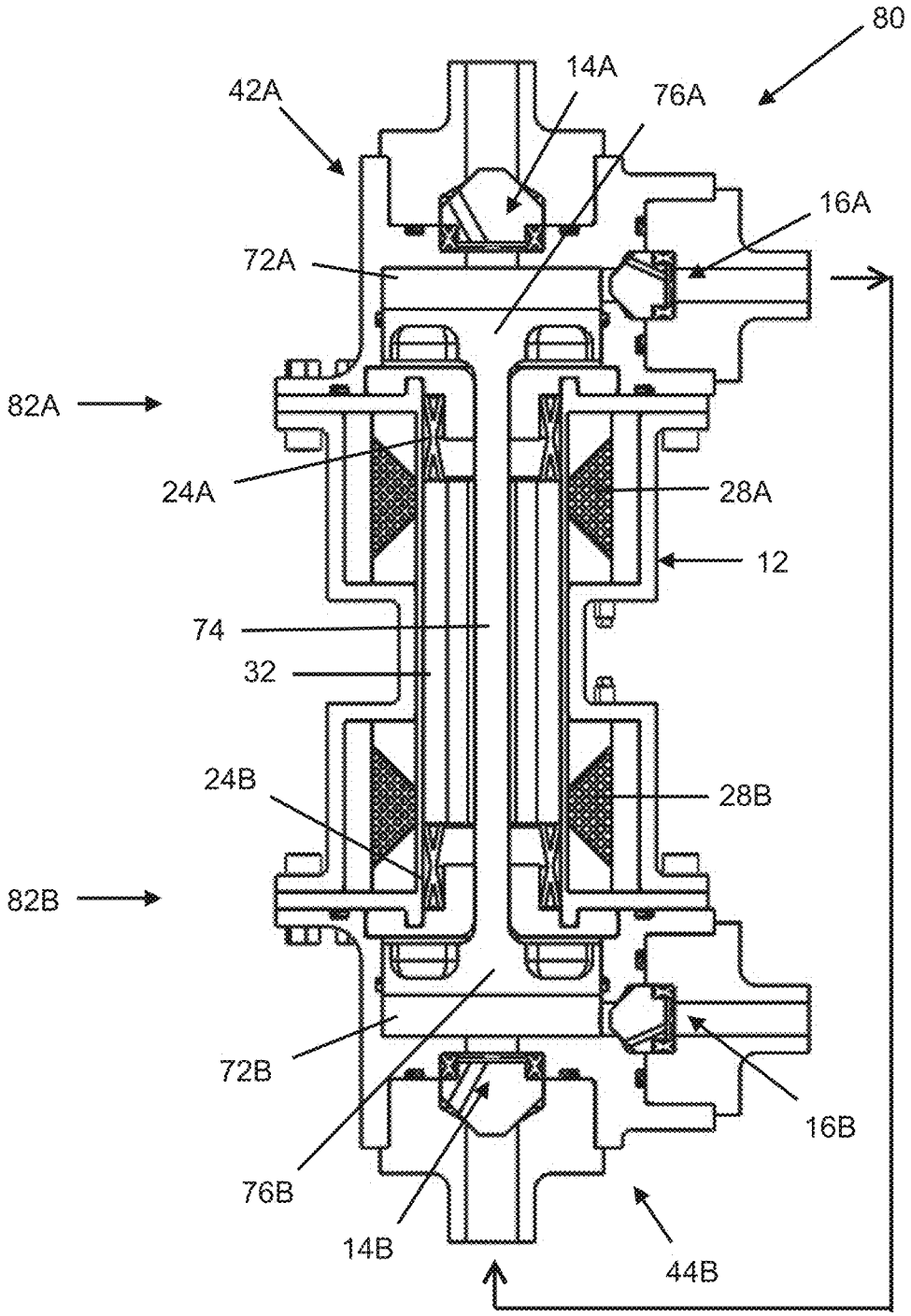
FIG. 7 shows a cross-section view of a third exemplary embodiment of a SCAMP for use with gases, in accordance with the present disclosure.

Referring now to FIG. 7, a cross-section view of a third exemplary embodiment of a SCAMP 80 for use with a gas as a working fluid, in accordance with the present disclosure. The SCAMP 80 of FIG. 7 is a double-acting variant of the SCAMP 10, 70 of FIGS. 1-3 and/or FIG. 6. In one embodiment, the configuration and operation of the SCAMP 80 of FIG. 7 is substantially the same as that of the SCAMP 10 of FIGS. 1-3 and/or the SCAMP 70 of FIG. 6 (and like elements are depicted using like reference numbers), with the exception that the at least one second spring 26 (for example, overtravel springs) and the third major current flow path 66 (high-resistance circuit) are eliminated.

Continuing to refer to FIG. 7, in one embodiment the SCAMP 80 of FIG. 7 is configured to function as a first pump section 82A and a second pump section 82B, and duplicated parts are indicated in FIG. 7 with letters "A" and "B." In one embodiment, the SCAMP 80 includes a first pump head 42A within the first pump section 82A and a second pump head 42B within the second pump section 82B. In one embodiment, the first and second pump heads 42A, 42B are mirror images of each other, except that the SCAMP includes a single piston 74 (or piston 20, as shown in FIGS. 1-3) and single armature 32 that each extend between the first and second pump sections 82A, 82B. In one embodiment, the SCAMP 80 includes a set of first electromagnetic coils 28A and a set of second electromagnetic coil(s) 28B. In one embodiment the SCAMP 80 includes a two sets of at least one spring 24A, 24B, such as two sets of armature return springs. During use, movement of the piston 74 toward the second pump head 42B will draw fluid through the first inlet valve 14A and into the first compression cavity 72A (and will discharge fluid through the second discharge valve 16B from the second compression cavity 72B) and movement of the piston 74 toward the first pump head 42A will draw fluid through the second inlet valve 14B and into the second compression cavity 72B (and will discharge fluid through the first discharge valve 16A from the first compression cavity 72A). It will be understood that the SCAMP 80 may have features or combinations of features that are similar to the SCAMP 10 of FIGS. 1-3 and/or the SCAMP 70 of FIG. 6. For example, in one embodiment the piston 74 and piston head 76 may be similar to the piston 20 and piston head of FIGS. 1-3, rather than as shown in FIG. 7. Further, it will be understood that the SCAMP 10, 70, 80 may have sizes, configurations, components, or combinations of components other than those shown and described herein.

Continuing to refer to FIG. 7, in one embodiment, when the third major current flow path 66 (high-resistance circuit) would normally be triggered, the set of first electromagnetic coil(s) 28A within the first pump section 82A are disengaged and the set of second electromagnetic coil(s) 28B are activated. This design enables increased pressure by feeding the discharge of the first pump section 82A through discharge valve 16A into the inlet valve 14B of the second pump section 82B to create a compounding pressure effect across a single SCAMP (that is, the SCAMP 80 as a whole), which is indicated with the arrowed path in FIG. 7. The two sets of at least one spring 24A, 24B (armature return springs) are balanced between the desired pressure ratios to offset pressure forces in this configuration. In one embodiment, this configuration of dual pump heads 42A, 42B of the SCAMP 80 provides a highly reliable, minimal leak path configuration for high pressure gases as the working fluid. Additionally, the configuration of the SCAMP 80 may be used for the configuration of the SCAMP 10 of FIGS. 1-3 for use with a liquid as the working fluid, such as if a redundant compression cavity is desired for reliability. In one embodiment, the SCAMP 80 also includes a coil liner 52 to fluidly isolate the electromagnetic coils 28A, 28B from the working fluid, such as when a liquid is used as the working fluid.

It should be understood that various aspects disclosed herein may be combined in different combinations than the combinations specifically presented in the description and the accompanying drawings. It should also be understood that, depending on the example, certain acts or events of any of the processes or methods described herein may be performed in a different sequence, may be added, merged, or left out altogether (e.g., all described acts or events may not be necessary to carry out the techniques).

As used herein, relational terms, such as "first" and "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention.

What is claimed is:

1. A device configured to interact with a working fluid, the device comprising:

a linear motion electromagnet, the linear motion electromagnet including at least one electromagnetic coil, a frame, and an armature within an armature cavity;

a compression cavity;

a piston within a piston cavity, the piston cavity at least partially defining the compression cavity, the armature being attached to at least a portion of the piston;

an inlet valve and a discharge valve, each of the inlet valve and the discharge valve being in fluid communication with the compression cavity;

at least one spring within the armature cavity;

a secondary flow circuit, the secondary flow circuit being configured to isolate the at least one electromagnetic coil from the working fluid; and a control unit, the control unit being in electrical communication with the at least one electromagnetic coil, the control unit including a control circuit having:

a first major current flow path being configured to charge the at least one electromagnetic coil;

a second major current flow path, the second major current flow path being a low-resistance circuit configured to retain a residual charge within the at least one electromagnetic coil; and a third major current flow path, the third major current flow path being a high-resistance circuit configured to dissipate the residual charge from the at least one electromagnetic coil, the control unit further including:

a voltage supply with a voltage supply switch;

a ground with a ground switch;

a coasting switch; and a retraction switch, the ground switch and the voltage supply switch being closed with the coasting switch and the retraction switch being open when a current is flowing through the first major current flow path;

the ground switch, the voltage supply switch, and the retraction switch being open and the coasting switch being closed when the current is flowing through the second major current flow path; and the retraction switch being closed and the ground switch, the voltage supply switch, and the coasting switch being open when the piston is retracting when the current is flowing through the third major current flow path.

2. The device of claim 1, wherein the working fluid is a cryogenic fluid.

3. The device of claim 1, wherein the secondary flow circuit includes:

a shaft seal; and a fluid return passage.

4. The device of claim 3, wherein the piston includes a shaft, the shaft seal being around the shaft of the piston.

5. The device of claim 4, wherein the shaft seal fluidly isolates the compression cavity from the armature cavity.

6. The device of claim 4, wherein the shaft seal is one of a mechanical seal, a hydrodynamic seal, and a combination thereof.

7. The device of claim 3, wherein the fluid return passage extends from the armature cavity to a location upstream of the inlet valve.

8. The device of claim 3, wherein the secondary flow circuit further includes a leak passage.

9. The device of claim 8, further comprising a housing, the housing at least partially defining the compression cavity and the armature cavity and including a housing seal, the leak passage being configured to vent an amount of working fluid leaked through the housing seal to a surrounding environment.

10. The device of claim 9, wherein the housing is configured to thermally transfer heat from the at least one electromagnetic coil into the working fluid.

11. The device of claim 3, wherein the secondary flow circuit further includes a coil liner, the coil liner being configured to isolate the at least one electromagnetic coil from the working fluid.

12. The device of claim 1, further comprising a shaft support system, the shaft support system including at least one of bushings, linear bearings, and hydrostatic bearings.

* * * * *